United States Patent [19]

Buschow et al.

[11] Patent Number: 5,041,171

[45] Date of Patent: Aug. 20, 1991

[54] HARD MAGNETIC MATERIAL

[75] Inventors: Kurt H. J. Buschow; Reinoud Van Mens; Dirk B. De Mooy, all of Eindhoven, Netherlands

[73] Assignee: U.S. Philips Corporation, New York, N.Y.

[21] Appl. No.: 65,538

[22] Filed: Jun. 23, 1987

[30] Foreign Application Priority Data

Jul. 18, 1986 [NL] Netherlands ..... 8601875

[51] Int. Cl.[5] ..... H01F 1/053

[52] U.S. Cl. ..... 148/301; 420/83

[58] Field of Search ..... 148/301, 302; 420/83, 420/121

[56] References Cited

FOREIGN PATENT DOCUMENTS 0101552 2/1984 European Pat. Off. .
0106948 5/1984 European Pat. Off. .
0108474 5/1984 European Pat. Off. .
60-144906 7/1985 Japan .
60-162750 8/1985 Japan .

OTHER PUBLICATIONS

Hadjipanayis, "Cobalt-Free Permanent Magnet Materials Based on Iron Rare Earth Alloys", J. Appl. Phys., 55(6), Mar. 15, 1984.

*Primary Examiner*—John P. Sheehan
*Attorney, Agent, or Firm*—Norman N. Spain

[57] ABSTRACT

The invention relates to new hard magnetic materials which have an intermetallic compound of tetragonal crystal structure of the $ThMn_{12}$ type. The intermetallic compound has the gross formula $ZA(Me^{I}_{1-x}Me^{II}_{x})_{12}$, wherein ZA is a rare earth metal from the group Sm, Er, Tm. $Me^{I}$ is Fe, Co or a mixture of the two, $Me^{II}$ is Ti, V, Cr or Si and x=0.1-0.2, preferably 0.12-0.17.

9 Claims, No Drawings

HARD MAGNETIC MATERIAL

BACKGROUND OF THE INVENTION

The invention relates to a hard magnetic material which comprises at least a rare earth metal and a transition metal chosen from the group consisting of iron and cobalt.

Known materials of this type are, for example, materials which comprise a rare earth metal, iron or a mixture of iron and cobalt and boron. These materials comprise a fine crystalline phase of a tetragonal crystal structure of substantially the composition $(RE)_2(Fe,Co)_{14}B$. A known compound of this type is $Nd_2Fe_{14}B$. This compound has particularly good magnetic properties.

However, it has been found in practice that poisonous boron compounds can easily be formed in the manufacture of the known boron-containing materials.

SUMMARY OF THE INVENTION

It is the object of the present invention to provide hard magnetic materials of good magnetic properties which do not comprise boron.

It has been found that this object can be achieved by materials of the type mentioned in the opening paragraph which according to the invention comprise an intermetallic compound of the gross formula $RE(Me^{I}_{1-x}Me^{II}_{x})_{12}$, wherein RE is one or more rare earth metal from the group formed by samarium, erbium and thullium, $Me^{I}$ is Fe, Co or a mixture of Fe and Co, and $Me^{II}$ is Ti, V, Cr, Si, W or Mo x being between 0.1 and 0.35, said compound having a tetragonal crystal structure of the $ThMn_{12}$ type.

DETAILED DESCRIPTION OF THE INVENTION

When x is smaller than 0.1 or larger than 0.35 the desired compound is obtained to an insufficient extent. x is preferably between 0.12 and 0.33. The rare earth metals can partly be replaced by other rare earth metals including lanthanum and yttrium without the magnetic properties being adversely influenced thereby essentially while certain properties can be improved thereby such as the magnetisation. In this manner, generally up to 50 at % can be replaced.

These compositions in general have a high magnetic remanance and energy product and a Curie temperature above 200° C. (473 K). The compositions in general have a higher resistance to corrosion than compositions comprising $(RE_2(Fe,Co)_{14}B$-type compounds. The intrinsic coercive force at room temperature is sufficiently high for practical applications. The saturation magnetization at room temperature may be more than 100 emu/g.

The invention is based on the recognition obtained of the fact that, although intermetallic compounds of the formula RE $Fe_{12}$ with the tetragonal $ThMn_{12}$-structure are not known, the $ThMn_{12}$ structure type is sufficiently stabilized upon substitution of a part of the $Me^{I}$ metal by other elements $Me^{II}$ in certain relatively small quantities, so that stable intermetallic compounds can be obtained having surprisingly good hard magnetic properties.

A crystal of the $ThMn_{12}$-type is described in an article by J. V. Florio, R. E. Rundle and A. I. Snow in Acta Cryst. 5 pp. 499–457 (1952).

Permanent magnetic materials can be obtained by melting, for example, by arc melting the desired elements in the relative quantities indicated by the above mentioned gross formula, or in relative quantities which are chosen to be so that after crystallization the intermetallic compound of the desired crystal structure is substantially obtained, thereby taking into account any evaporation losses during melting.

The invention will now be described in greater detail with reference to the following specific examples:

EXAMPLE 1

A hard magnetic material of the composition $Sm(Fe_{0.83}V_{0.17})_{12}$ was prepared by melting in an argon atmosphere the elements of this composition in the relative quantities: samarium: 24.2% by weight, iron 64.1% by weight and vanadium 11.7% by weight. Some excess samarium is present at the start of the melting to compensate for evaporation losses during melting. After cooling and solidifying, a body comprising fine crystallites of the desired crystal structure ($ThMn_{12}$-type) was obtained. The anisotropy field at 20° C. was at least 80 kilo Oersted. This corresponds to the value which is found for $Nd_2Fe_{14}B$. The compounds in which RE = Sm have an easy axis of magnetization parallel to the crystallographic C-axis. The Curie temperature is 610 K. Other compositions such as $Er(Fe_{0.83}V_{0.17})_{12}$ and Tm $(Fe_{0.83}V_{0.17})_{12}$ were prepared in the same way. They have the same $ThMn_{12}$ structure, good magnetic properties and a Curie temperature of 505 and 496 K. respectively.

EXAMPLE 2

Hard magnetic materials of various compositions $Sm(Fe_{1-x}Cr_x)_{12}$, wherein x was varied between 0.12 and 0.17 were prepared. They all contained crystallites of the $ThMn_{12}$-structure.

EXAMPLE 3

A hard magnetic material of the composition $SM(Fe_{0.415}Co_{0.415}Si_{0.17})_{12}$ was prepared by melting a mixture of the elements. A body comprising fine crystallites of the $ThMn_{12}$-structure was obtained.

What is claimed is:

1. A boron-free hard magnetic material comprising an intermetallic compound of the formula $RE(Me^{I}_{1-x}Me^{II}_{x})12$, which compound has a $ThMn_{12}$ tetragonal structure, wherein RE is at least one rare earth metal selected from the group consisting of Sm, Er and Tm, and up to 50 atomic percent of any of the other rare earth metals including La and Y, $Me^{I}$ is at least one metal selected from the group consisting of Fe and Co, $Me^{II}$ is an element selected from the group consisting of Ti, V, Cr, Si, W and Mo and x is between 0.1 and 0.35.

2. A hard magnetic material as claimed in claim 1, characterized in that the intermetallic compound has the composition $Sm(Fe_{1-x}Cr_x)_{12}$ wherein x=0.12–0.33.

3. A hard magnetic material as claimed in claim 1, characterized in that the said rare earth metals are replaced up to 50 at % by one or more other rare earth metals including lanthanum and yttrium.

4. A hard magnetic material as claimed in claim 1, characterized in that x is between 0.12 and 0.33.

5. A hard magnetic material as claimed in claim 1, characterized in that RE=Sm, $Me^{I}$=Fe and $Me^{II}$=V.

6. A hard magnetic material as claimed in claim 5, characterized in that the intermetallic compound has the composition $Sm(Fe_{0.83}V_{0.17})_{12}$.

7. A hard magnetic material as claimed in claim 1, characterized in that the intermetallic compound has the composition $Sm(Fe_{1-x}Cr_x)_{12}$, wherein x=0.1–0.35.

8. A hard magnetic material as claimed in claim 1, characterized in that RE=Sm, $Me^{I}$=Fe, Co and $Me^{II}$=Si.

9. A hard magnetic material as claimed in claim 1, characterized in that the intermetallic compound has the composition $Sm(Fe_{0.415}Co_{0.415}Si_{0.17})_{12}$.

* * * * *